US008844769B2

(12) United States Patent
Rosenkranz et al.

(10) Patent No.: US 8,844,769 B2
(45) Date of Patent: Sep. 30, 2014

(54) DISPENSER HOUSING WITH LOCKING MECHANISM

(71) Applicant: GOJO Industries, Inc., Akron, OH (US)

(72) Inventors: Mark E Rosenkranz, Medina, OH (US); Robert L Quinlan, Jr., Stow, OH (US); David D Hayes, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 26 days.

(21) Appl. No.: 13/955,075

(22) Filed: Jul. 31, 2013

(65) Prior Publication Data

US 2013/0306677 A1 Nov. 21, 2013

Related U.S. Application Data

(63) Continuation of application No. 12/505,900, filed on Jul. 20, 2009, now Pat. No. 8,561,847.

(51) Int. Cl.

| | |
|---|---|
| ***B67B 1/00*** | (2006.01) |
| ***A47K 5/12*** | (2006.01) |
| ***A47K 10/38*** | (2006.01) |

(52) U.S. Cl.

CPC .. *A47K 5/12* (2013.01); *A47K 10/38* (2013.01)
USPC ..... 222/153.03; 222/153.09; 222/165; 222/181.3; 221/154; 137/383; 70/345; 70/459

(58) Field of Classification Search

USPC ..... 222/153.01, 153.03–153.04, 160, 222/164–165, 173, 180, 181.3; 221/154; 137/383; 70/63, 162, 345, 387, 456 R, 70/459; 292/80–81, 87, 95–96, 121, 128, 292/101, 194–195, DIG. 11, DIG. 63

See application file for complete search history.

(56) References Cited

U.S. PATENT DOCUMENTS

| | | | | |
|---|---|---|---|---|
| 4,391,111 | A * | 7/1983 | Marcy | 70/162 |
| 4,651,544 | A * | 3/1987 | Hungerford | 70/63 |
| 5,170,907 | A * | 12/1992 | Sakai | 220/481 |
| 5,183,182 | A * | 2/1993 | Comstock et al. | 222/129 |
| 5,695,065 | A * | 12/1997 | Kennedy et al. | 206/554 |
| 6,772,916 | B1 * | 8/2004 | Reynolds | 222/181.3 |
| 7,044,328 | B1 * | 5/2006 | Ciavarella | 220/835 |
| 7,232,045 | B2 * | 6/2007 | Ophardt et al. | 222/180 |
| 7,637,391 | B2 * | 12/2009 | Rosenkranz et al. | 222/52 |
| 7,654,417 | B2 * | 2/2010 | Rhodenbaugh et al. | 222/153.03 |
| 7,984,829 | B2 * | 7/2011 | Cittadino et al. | 222/153.03 |
| 2006/0000335 | A1 * | 1/2006 | Chen | 83/649 |

* cited by examiner

*Primary Examiner* — Paul R Durand
*Assistant Examiner* — Andrew P Bainbridge

(57) ABSTRACT

A dispenser housing has a closure mechanism that serves to hold the dispenser housing closed. A key either can be carried by an individual to be employed to override the closure mechanism to permit the opening of the dispenser or can be selectively mounted to the dispenser housing to position a release mechanism appropriately to permit the release mechanism to be manipulated to override the closure mechanism. When the key is not mounted to the dispenser, the release mechanism cannot be appropriately manipulated to override the closure mechanism.

3 Claims, 7 Drawing Sheets

DISPENSER HOUSING WITH LOCKING MECHANISM

CROSS-REFERENCE TO RELATED APPLICATION

This application is a continuation of U.S. Pat. No. 8,561,847, issued on Oct. 22, 2013, the contents of which are incorporated herein by reference.

FIELD OF THE INVENTION

The present invention generally relates to dispensers and, particularly dispenser housings. More particularly, the present invention relates to a dispenser housing having a closure mechanism that serves to hold the dispenser housing closed. A key either can be carried by an individual to be employed to override the closure mechanism to permit the opening of the dispenser or can be selectively mounted to the dispenser housing to position a release mechanism appropriately to permit the release mechanism to be manipulated to override the closure mechanism, wherein, when the key is not mounted to the dispenser, the release mechanism cannot be appropriately manipulated to override the closure mechanism.

BACKGROUND OF THE INVENTION

Wall-mounted dispenser housings and other other dispenser housings are well known in the art. Typically a cover portion of the housing interacts with a base portion of the housing to define an internal space where product may be retained for dispensing. In wall-mounted dispensers, a back plate is typically mounted to a wall, and a cover interacts with the back plate to define an internal volume that receives a refill unit holding a desired product. For example, wall-mounted soap dispensers typically include a dispenser housing structure, that receives a refill unit made up of a soap container and an associated soap pump that can be actuated to dispense soap from the container.

The dispenser housings are typically more permanent structures, while the refill units are disposable. That is, once the product retained within the refill unit is depleted, the empty refill unit is removed and replaced with a full one. Thus, during the life of a dispenser housing, it may be opened and closed multiple times to remove empty refill units and replace them with full refill units.

Because dispenser housings are often available for use by the general public, it is necessary to design the dispenser housings in such a way that unauthorized individuals are unable to access the contents (for example, refill units) therein. If a dispenser housing is easy to open, unauthorized individuals may open the dispenser housing and remove the product held therein. The owner of the dispenser will thereafter have to replace the stolen product, much to his detriment. Thus, many prior art dispenser housings are provided with locking mechanisms.

Many of the locking mechanisms employed are very common and straightforward. For example, some dispensers are simply locked by a lock-and-key structure much like the turn key structures used to lock a door or chest. An example can be found in U.S. Pat. No. 4,662,195. Other locking mechanisms involve keys that must be inserted into apertures specifically adapted for their receipt, with the key contacting mechanisms within the dispenser housing to release the cover from the base. An example can be found in U.S. Pat. No. 6,772,916. Notably, the key taught in the U.S. Pat. No. 6,772,916 might be either carried by service personnel or, alternatively, permanently mounted in the dispenser housing.

In embodiments where the key must be carried by service personnel, there is an obvious problem when the service personnel have lost the key. When the key is lost, it can be very difficult or even impossible to open the dispenser housing without damaging components. In embodiments where the key is mounted to the dispenser housing, the housing is again susceptible to being accessed by unauthorized users, once those unauthorized users discovery how the key can be accessed and manipulated. Nevertheless, some entities that provide dispensers for use by the general public prefer to have the key permanently mounted as opposed to having service personnel carry the keys. For example, where theft of the dispenser contents is a concern, it may be desirable to have the service personnel carry keys, while, in areas where theft is not a concern, it may be advisable to have the key permanently mounted or to otherwise provide a dispenser that can be opened without having to be unlocked from a locked state by use of a key.

Though different entities purchasing dispensers may prefer different dispensers (i.e., some may prefer mounted keys and some may prefer carried keys), for purposes of efficient production, it is desirable to provide a single dispenser that is selectively configured to have a mounted key or a carried key in accordance with the desire of the dispenser owner. Thus, the dispenser housing arts would benefit from a dispenser housing that can be operated in different modes—one in which the dispenser can be locked closed, to be opened only by use of a key, and one in which the dispenser can be opened and closed, at will, without the need to use a key.

SUMMARY OF THE INVENTION

In one embodiment, this invention provides a dispenser housing including a base; a cover movable between an open position and a closed position relative to said base; a closure mechanism; a release mechanism having a rest position and a key-induced position, wherein, in said rest position, said release mechanism cannot be manipulated to override said closure mechanism, and, in said key-induced position, said release mechanism can be manipulated to override said closure mechanism; a keyhole; and a key selectively carried by an individual or selectively mounted to said dispenser housing, wherein, when selectively mounted to said dispenser housing, said key moves said release mechanism to said key-induced position, and, when carried by an individual, said key can be selectively inserted into said keyhole to override said closure mechanism.

DETAILED DESCRIPTION OF ILLUSTRATIVE EMBODIMENTS

The concepts of the present invention are disclosed with reference to a particular embodiment of a wall-mounted soap dispenser. However, it should be appreciated that these concepts can be applied to other dispenser housings, and not just those that are wall-mounted. Additionally, while certain elements are shown associated with a cover and other elements associated with a base or back plate, it should be appreciated that such placements could be reversed or positioned elsewhere in accordance with the inventive concepts taught herein.

Figure 1:
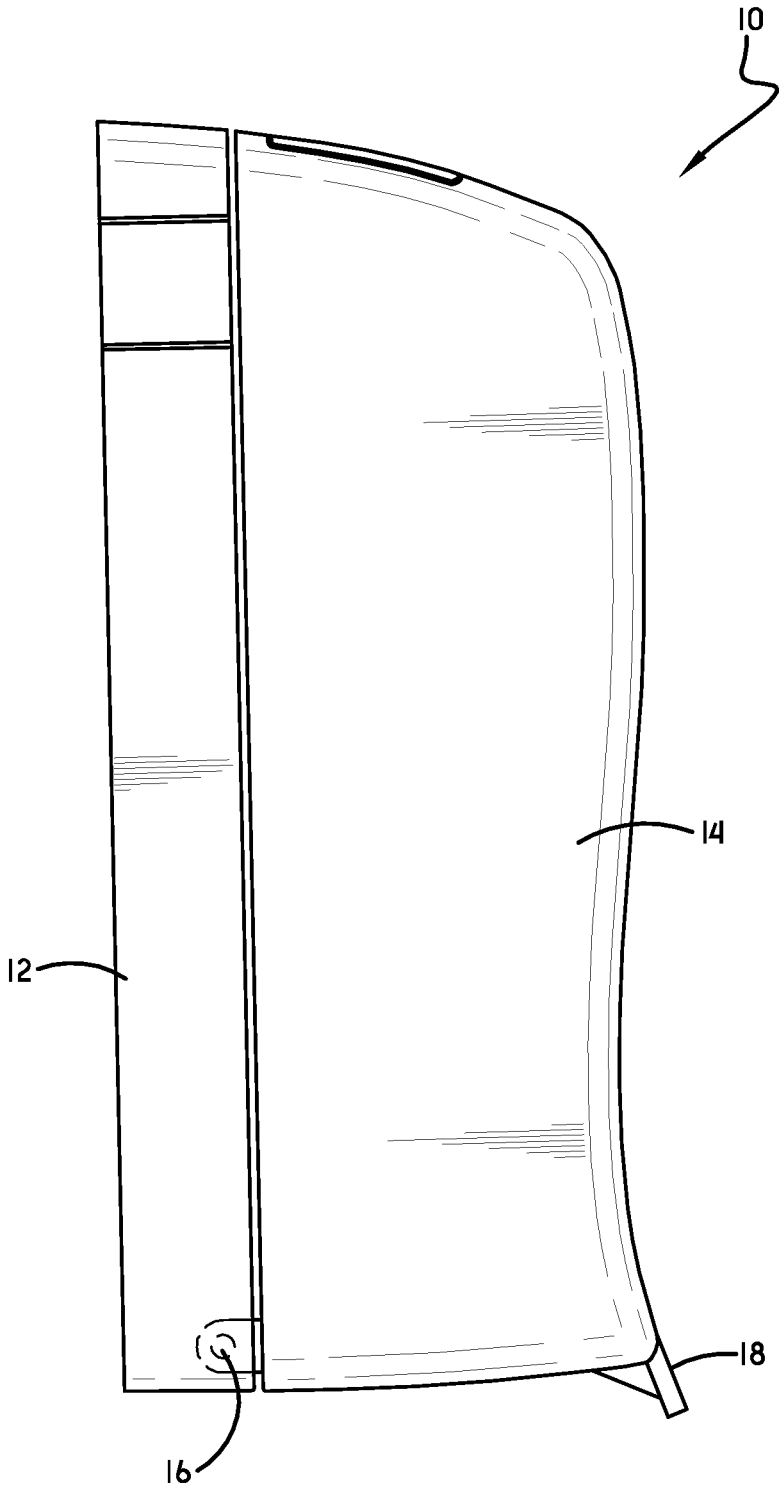
FIG. 1 is a side view of the exterior of a dispenser housing in accordance with this invention.
Figure 2:
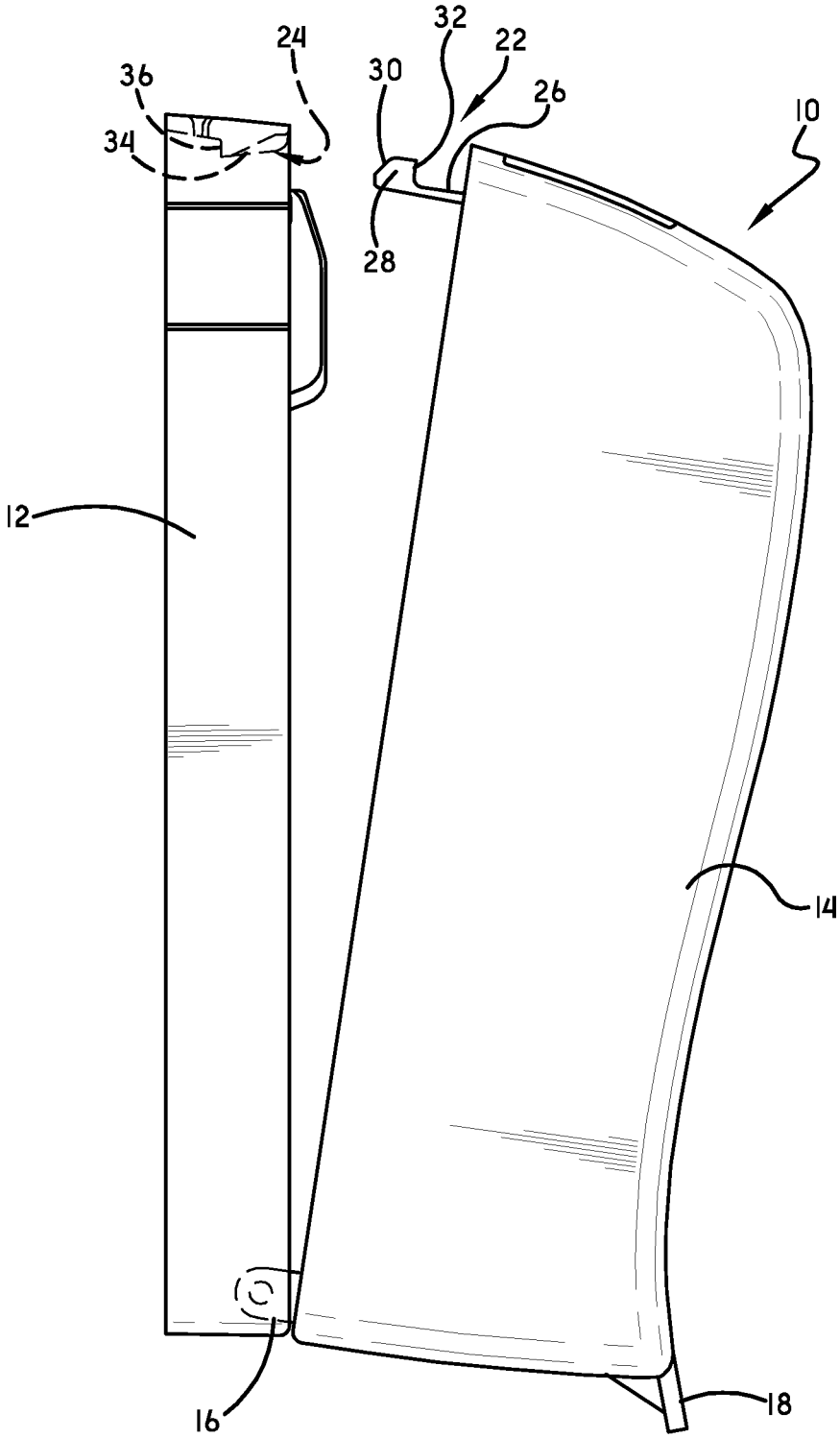
FIG. 2 is a side view of the dispenser housing of FIG. 1 shown as the cover is being opened off of the back plate or base.
Figure 3:
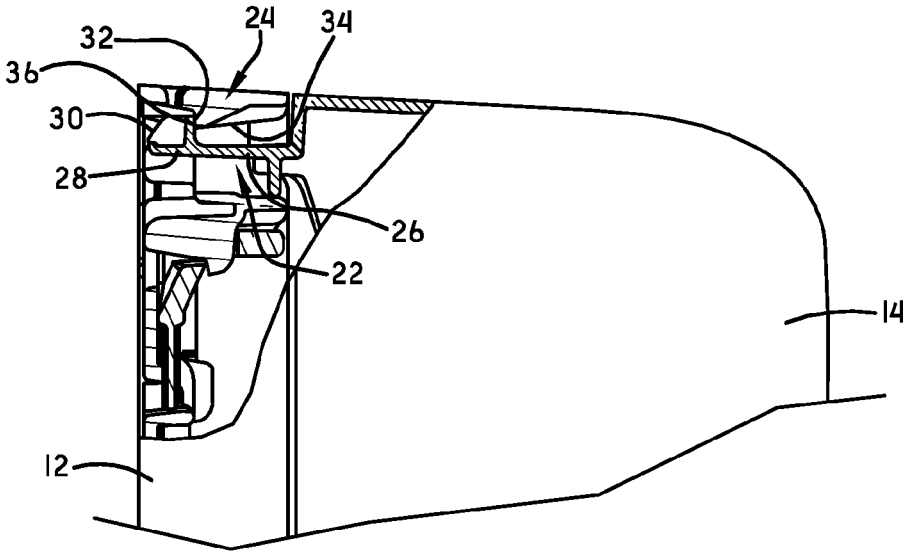
FIG. 3 is a cross sectional view of the dispenser housing, showing the interaction of latch and catch mechanisms when the dispenser housing is in a closed position.

With reference to FIG. 1, a dispenser housing in accordance with this invention is shown and designated by the numeral 10. The dispenser housing 10 includes a base or back plate 12, which includes structures for mounting to a wall. A cover 14 is pivotally secured to the back plate 12, as at hinge 16, such that the cover 14 can pivot from a closed position, as shown in FIG. 1, to an open position, as shown in FIG. 2. In the open position, an empty refill unit can be removed from the dispenser housing 10 and replaced with a full refill unit as known. In this particular embodiment dealing with a wall-mounted soap dispenser housing, the refill unit would typically be a container and pump combination, wherein the container holds soap or other hand-treatment product, and a pump is associated with the container to dispense the soap or hand-treatment product from the container. In some embodiments, a push bar 18 of the dispenser housing 10 is manipulated and engages the pump of the refill unit to cause the product in the container to be dispensed onto a user's hand. In other embodiments, as sensor in the dispenser housing senses the presence of a hand below the dispensing area and activates the mechanisms that dispense the product.

As seen in FIG. 2, the top wall 20 of the cover 14 carries a latch 22 that extends away from the cover 14 and toward the back plate 12. As seen in FIGS. 2, 3, 6 and 8, the back plate 12 carries a catch 24, which interacts with the latch 22 to hold the dispenser housing in the closed position of FIG. 1. The latch 22 includes a flexible extension 26 and a beveled head 28, which has a beveled surface 30 and stop surface 32. The catch 24 includes a latch contact surface 34 and a stop surface 36, and, as the cover 14 is moved from an open position to the closed position, the beveled surface 30 of the beveled head 28 engages the latch contact surface 34 of the catch 24, causing the flexible extension 26 to bend and permit the beveled head 28 to move past the catch 24. Once the beveled head 28 moves past the catch 24, it is urged upwardly to the lock position shown in FIG. 3 because the flexible extension 26 reverts back toward its unbent shape. This places stop surfaces 32 and 36 in alignment (horizontal alignment in this embodiment) such that the cover 14 is secured to the back plate by the interaction of the latch 22 and the catch 24. The stop surfaces 32, 36 must be brought out of alignment in order to open the cover 14 off of the back plate 12 on hinge 16, for example, for servicing the dispenser or removing and replacing a refill unit.

The latch 22 and the catch 24 form what is broadly referred to herein as a closure mechanism, and it should be appreciated that virtually any closure mechanism could be employed in accordance with the concepts taught herein, and this invention is not limited to or by the specific interaction of latch and catch mechanisms. Also, as already mentioned in the introductory paragraph to this Detailed Description section, the latch and catch can be otherwise positioned. Also it will be apparent that the latch and catch can take various forms, as such mechanisms and their interaction are well known.

Figure 4:
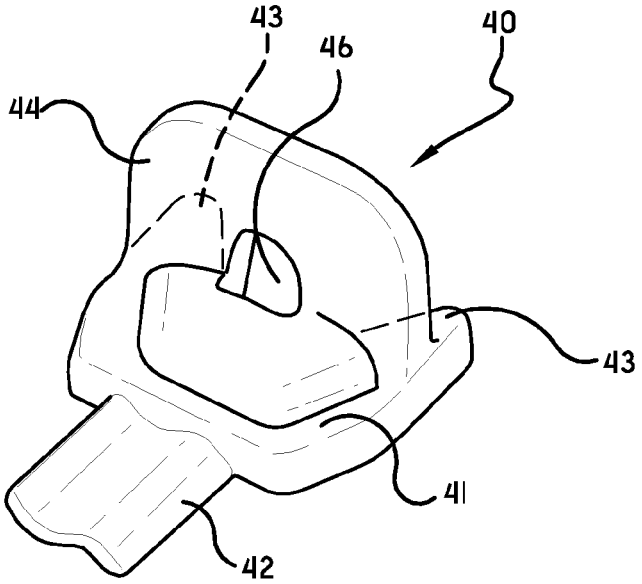
FIG. 4 is a general prospective view of the key.

In accordance with this invention, a key 40, shown in perspective in FIG. 4, can either be carried by an individual to use the key 40 to manipulate the latch 22, or can be mounted to the dispenser housing 10 to position a release mechanism 60 (FIG. 6) such that the release mechanism 60 can be manipulated to move the latch 22. When the key is not mounted to the dispenser housing 10, and is instead carried by an individual for use, the release mechanism 60 is prevented from moving sufficiently to disengage the latch 22 from the catch 24.

The key 40 includes a body 41 from which extends a key head 42, release supports 43 and a plate 44. The plate 44 has an aperture 46, which, as will be seen, can help secure the key 40 to the dispenser housing 10, particularly at the back plate 12.

Figure 5:
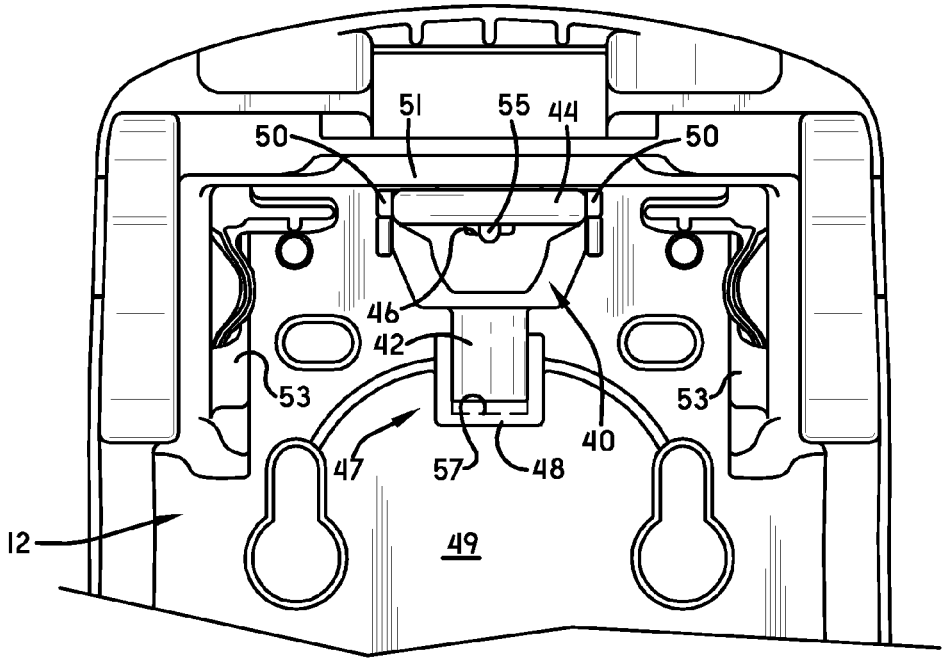
FIG. 5 is a front plan view of the back plate of the dispenser housing, showing the structures that serve to permit the mounting of the key to the back plate to interact with the release mechanism and place it in the key-induced position.
Figure 6:
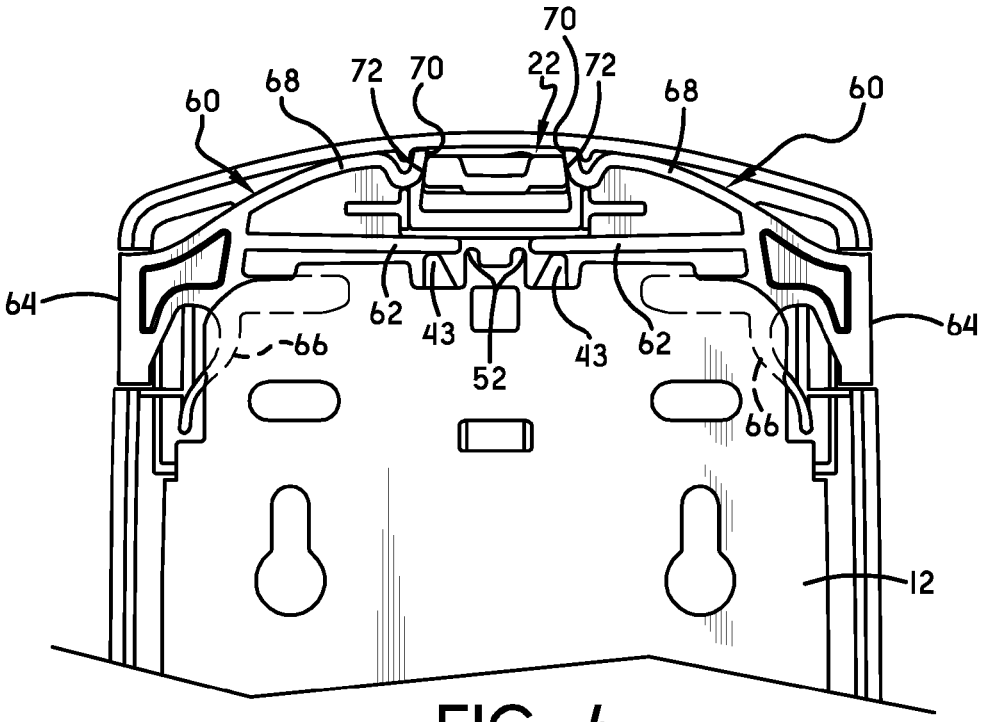
FIG. 6 a rear view of the dispenser housing, showing the interaction of latch and catch mechanisms, and the key-induced position of the release mechanism that is shown in a rest position in FIG. 4.

With reference to FIGS. 4-6, it can be seen that the key 40 can selectively be mounted to the dispenser housing 10, and, in this embodiment, is shown mounted to the back plate 12, though it will be appreciated that the concepts of this invention could be practiced with the mounting of the key 40 otherwise positioned. In this embodiment, the back plate 12 provides a key mount (generally indicated at 47) that is appropriately configured to receive the key 40 and hold it to the back plate 12. The key mount 47 includes a key head mount bracket 48 at an internal surface 49 of the back plate 12, and this key head mount bracket 48 is spaced from support apertures 50 at an appropriate distance such that the release supports 43 of the key 40 extend through the support apertures 50 when the key head 42 is mounted to the key head mount bracket 48. To secure the key 40 to the back plate 12, the supports 43 are inserted into the support apertures 50, and then the key head 42 is snapped into position in the key head mount bracket 48. In this embodiment, the plate 44 of the key 40 butts up against an inwardly extending ledge 51 of the back plate 12, and a tab 55 extends into the aperture 46 to further secure the key 40 to the back plate 12, and make it difficult to inadvertently remove the key 40 from this mounted position. As appreciated from the dashed lines at the key head mounting bracket 48, the key head 42 extends into a recess 57 and is snap fit therein.

Figure 7:
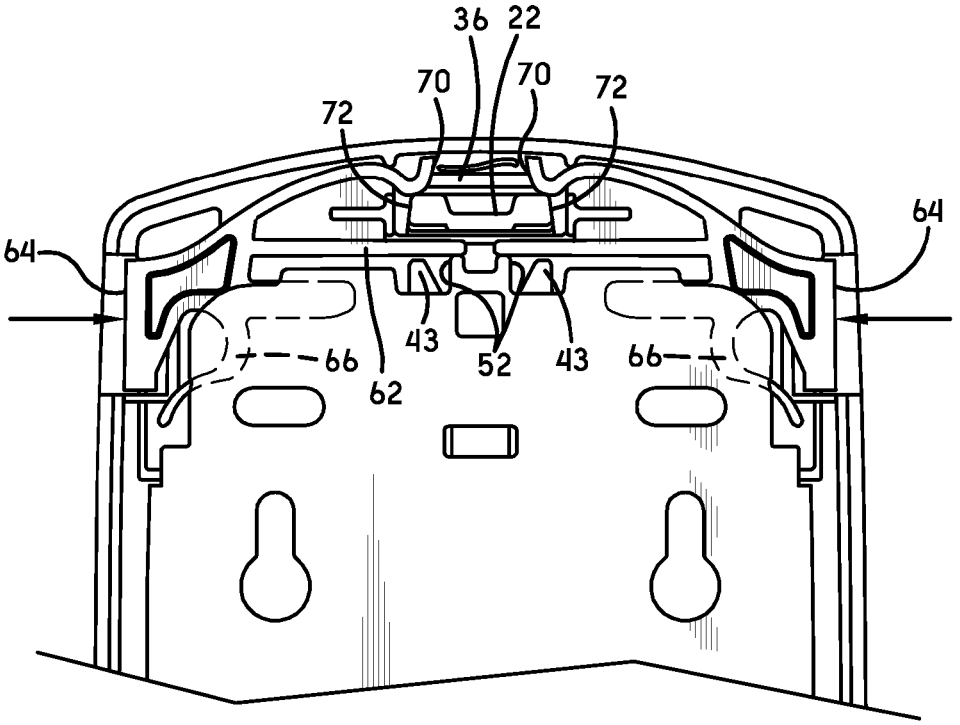
FIG. 7 is a rear view of the dispenser housing, showing how the manipulation of the release mechanism, when in the key-induced position, serves to release the latch from the catch mechanism.
Figure 11:
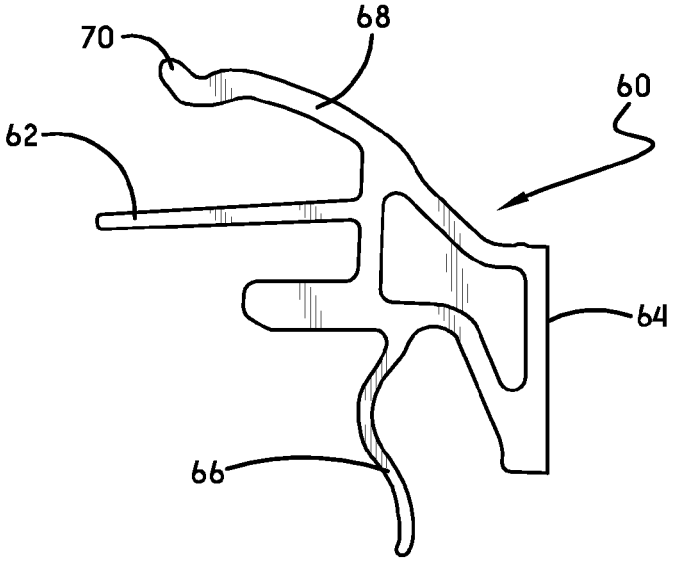
FIG. 11 is a plan view of one release mechanism.

As seen in the rear view of FIGS. 6 and 7, the release supports 43 each engage their own associated release mechanism 60, particularly at lock extensions 62. Although two, opposed release mechanisms are shown and are useful for permitting a user-friendly squeeze actuation of the release mechanics, it will be appreciated that the concepts herein will work well with one release mechanism 60. Notably, the release supports 43 support the lock extensions 62 such that they reside, in this particular embodiment and orientation, above stop surfaces 52 on the back plate 12. The lock extensions 62 each extend to buttons 64 of the release mechanism 60, and these buttons are biased to the position of FIG. 6 by biasing supports 66, which engage bias mechanism mounts 53 (FIG. 5), which, in this embodiment, are formed in the back plate 12. As seen in FIG. 11, the biasing supports 66 are formed integrally with the buttons 64, though they do not necessarily have to be so formed. The biasing supports 66 naturally extend from the buttons 64 in a specific relation thereto such that, when the release mechanisms 60 are mounted to the back plate 12, with biasing supports 66 forced into bias mechanism mounts 53, the biasing supports 66 tend to push against the biasing supports 53 to move the buttons 64 to the position shown in FIG. 6, flush with the side wall 54 of the back plate 12. A latch release extension 68 extends from each of the buttons 64 and provides a sloped surface 70 aligned with a sloped surface 72 at each end of the latch 22.

As can be seen in a comparison between FIGS. 6 and 7, the buttons 64 may be pressed toward each other to cause the sloped surface 70 of the release mechanism to press against the sloped surfaces 72 of the latch 22 and force the latch 22 downwardly so that stop surfaces 32 and 36 are no longer in alignment, as seen by the exposure of stop surface 32 of catch 24 in FIG. 7. With the latch 22 disengaged from the catch 24, the cover 14 can be opened off the back plate 12. Notably, the release supports 43 hold the lock extension 62 of the release mechanism above the stop surfaces 52 so that the buttons can be pressed toward each other as shown in FIG. 7. This position shown in FIGS. 6 and 7 is to be understood herein as the "key-induced position" of the release mechanism 60. This is to be distinguished from the rest position that will now be disclosed and in which the key 40 is not mounted to the dispenser housing 10.

Figure 8:
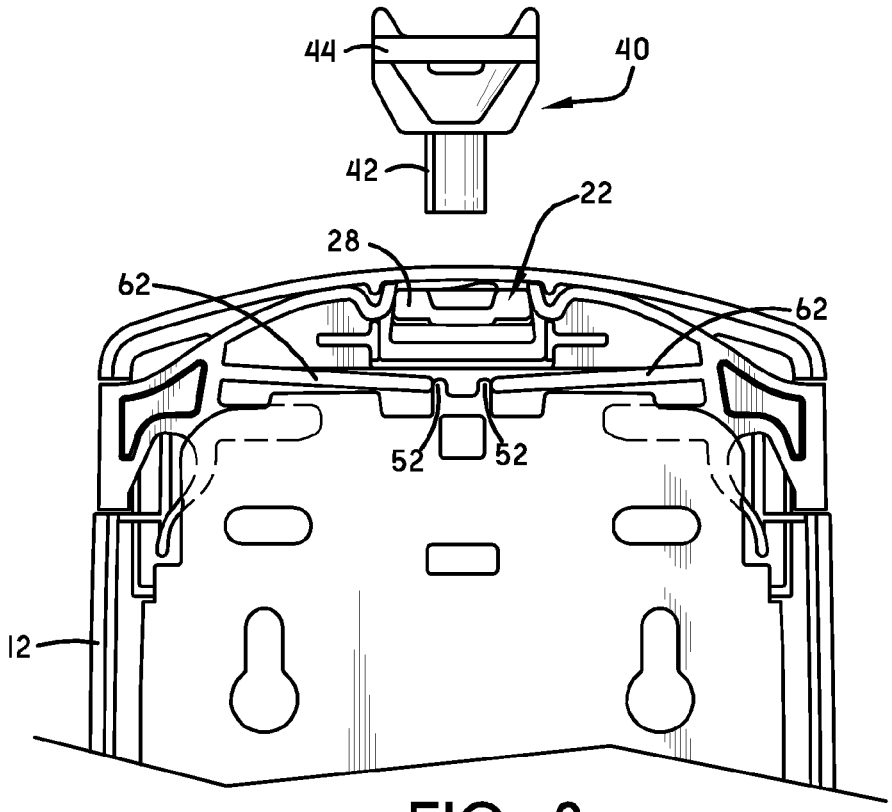
FIG. 8 is a rear view of the dispenser housing, showing the interaction of latch, and catch mechanisms, the rest position of a release mechanism, and a key positioned to interact with a keyhole, which is shown in FIG. 5.
Figure 10:
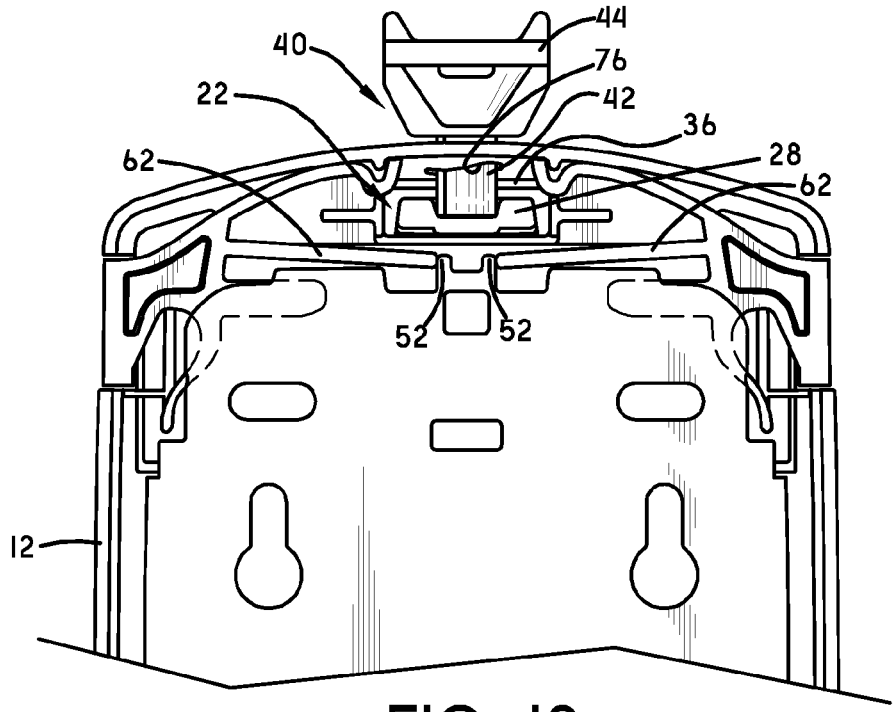
FIG. 10 is a rear view of the dispenser housing, showing the removal of the latch from the catch mechanism when the key is inserted into the keyhole to press on the latch.
Figure 9:
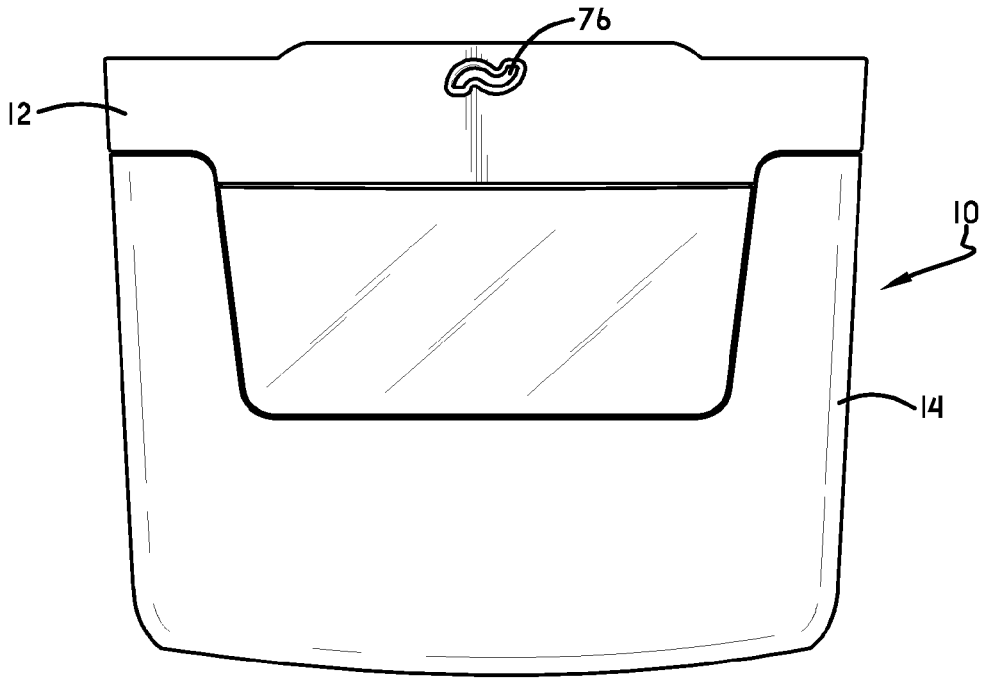
FIG. 9 is a top plan view of the dispenser, showing a keyhole in the top wall of the back plate.

Referring now to FIG. 8, it can be seen that, with the key 40 removed from the dispenser housing 10, the lock extensions 62 of the release mechanism extend slightly downwardly such that they are laterally aligned with the stop surfaces 52. Thus, the buttons are prevented from being moved inwardly as previously shown in FIG. 7. In this rest position, the release mechanism 60 cannot be employed to open the dispenser housing. Instead, as shown in FIGS. 8-10, the key 40 must be used. Particularly, the key 40 is positioned with the key head 42 appropriately oriented with a key hole 76 in the top surface of the dispenser housing 10, in this embodiment, in the back plate 12. This key hole 76 is aligned with the beveled head 28 of the latch 22 such that, inserting the key head 42 into the key hole 76 eventually engages the key head 42 with the beveled head 28 to force it downwardly (FIG. 10) and remove the latch 22 from the catch 24, by bringing stop surfaces 32 and 36 out of alignment, as seen by the exposure of stop surface 32 of catch 24 in FIG. 10. Thus, by employing the key 40, the latch 22 can be removed from the catch 24, and the dispenser housing 10 can be opened. This is true whether or not a key is mounted to the dispenser housing. The plate 44 provides some support to the user for pushing downwardly on the key 40, to prevent the key 40 from slipping in the individual's hand when the key head 42 engages the latch 22.

This dispenser housing permits the owner to decide how the dispenser interior might be accessed for service or for replacement of an empty refill unit. For those owners concerned with vandalism or theft or otherwise concerned with permitting any individual to access the interior of the dispenser housing, the key can be removed from the dispenser housing and retained in the possession of the owner or placed in the possession of appropriate service personnel. With the key not mounted to the dispenser housing, the release mechanism, even if located and appreciated as such by an individual, cannot be manipulated to open the dispenser housing. Indeed, the dispenser housing will be difficult to open without damaging components thereof. Where an owner has little concern that individuals will attempt to access the contents of the dispenser housing, the owner may leave the key mounted to the dispenser housing such that the release mechanism can be manipulated to open the dispenser housing. This permits the dispenser housing manufacturer to create a single dispenser housing with key and release mechanism and yet permit the end owner to determine what type of dispenser housing they will provide—one opened by key or one opened by release mechanism manipulation.

In light of the foregoing, it should be appreciated that the present invention significantly advances the art by providing a dispenser housing that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A dispenser housing comprising:

a base;

a cover movable between an open position and a closed position relative to said base;

a closure mechanism;

a release mechanism having a rest position and a key-induced position, wherein, in said rest position, said release mechanism cannot be manipulated to override said closure mechanism, and, in said key-induced position, said release mechanism can be manipulated to override said closure mechanism;

a keyhole;

a key selectively carried by an individual or selectively mounted to said dispenser housing, wherein, when selectively mounted to said dispenser housing, said key moves said release mechanism to said key-induced position, and, when carried by an individual, said key can be selectively inserted into said keyhole to override said closure mechanism.

2. A dispenser housing of comprising:

a base;

a cover movable between an open position and a closed position relative to said base;

a closure mechanism;

a release mechanism having a rest position and a key-induced position, wherein, in said rest position, said release mechanism cannot be manipulated to override said closure mechanism, and, in said key-induced position, said release mechanism can be manipulated to override said closure mechanism;

a keyhole;

a key selectively carried by an individual or selectively mounted to said dispenser housing, wherein, when selectively mounted to said dispenser housing, said key moves said release mechanism to said key-induced position, and, when carried by an individual, said key can be selectively inserted into said keyhole to override said closure mechanism; and a stop surface on said base, said release mechanism comprising:

a lock extension that, in said rest position of said release mechanism, aligns with said stop surface of said base such that said release mechanism cannot be manipulated to override said closure mechanism due to contact between said lock extension and said stop surface.

3. The dispenser housing of claim 2, wherein, in said key-induced position of said release mechanism, said key moves said lock extension out of alignment with said stop surface of said base such that said release mechanism can be manipulated to override said closure mechanism.

* * * * *